US005244626A

United States Patent [19]

Finkl et al.

[11] Patent Number: 5,244,626

[45] Date of Patent: Sep. 14, 1993

[54] HOT WORK DIE BLOCK

[75] Inventors: Charles W. Finkl, Evanston; Nicholas Cerwin, Palatine, both of Ill.

[73] Assignee: A. Finkl & Sons Co., Chicago, Ill.

[21] Appl. No.: 924,144

[22] Filed: Aug. 3, 1992

Related U.S. Application Data

[63] Continuation-in-part of Ser. No. 841,151, Feb. 25, 1992, abandoned, which is a continuation-in-part of Ser. No. 684,621, Apr. 21, 1991, abandoned.

[51] Int. Cl.[5] ..... C22C 38/44; C22C 38/50

[52] U.S. Cl. ..... 420/109; 420/84

[58] Field of Search ..... 420/109, 84

[56] References Cited

U.S. PATENT DOCUMENTS

| | | | |
|---|---|---|---|
| 3,929,423 | 12/1975 | Finkl | 420/109 |
| 4,318,739 | 3/1982 | Lehman | 420/109 |
| 4,673,433 | 6/1987 | Roberts | 420/109 |
| 5,059,389 | 10/1991 | Finkl et al. | 420/109 |

*Primary Examiner*—Deborah Yee
*Attorney, Agent, or Firm*—Baker & McKenzie

[57] ABSTRACT

A low alloy steel product having high hardenability and good machaniability in the presence of a relatively low S content, and utilizing minimal quantities of the currently expensive elements Ni and Mo is disclosed, the product having the following approximate composition:

| | | | | |
|---|---|---|---|---|
| C | from about | .42 | to about | .52 |
| Si | from about | .15 | to about | .35 |
| Ni | from about | .65 | to about | .95 |
| Cr | from about | 1.40 | to about | 1.60 |
| Mo | from about | .30 | to about | .50 |
| Mn | from about | .75 | to about | .95 |
| V | from about | .04 | to about | .10 |
| S | from about | .010 | to about | .025 |
| Ti | from about | .003 | to about | .075 |
| Al | from about | .015 | to about | .030 |
| Ca | about 15% of Al | | | |
| H | 2.2 ppm max | | | |
| O | 30 ppm max | | | |
| Fe | balance and non-deleterious impurities | | | |

4 Claims, No Drawings

HOT WORK DIE BLOCK

This application is a continuation-in-part of application Ser. No. 841,151 filed Feb. 25, 1992, now abandoned, which application in turn was a continuation-in-part of application Ser. No. 684,621 filed Apr. 21, 1991, now abandoned.

This invention relates to a low alloy steel product, such as hot work die block, and particularly to such a die block which has excellent hardenability and a high critical diameter while requiring minimal quantities of the currently expensive elements Ni and Mo.

SUMMARY OF INVENTION

For a hot work die block, the characteristic of hardenability is a very important characteristic of the final product. As will be appreciated by those skilled in the art a hot work die block is now almost exclusively used in conjunction with the production of long runs of forged parts. An industry objective therefore is to provide a steel part which will produce the same, or nearly the same, (and, of course, if possible, greater) production on the last sinking as on the first sinking. This objective translates into hardenability (not to be confused with hardness), that is, the ability of a piece of steel to possess the same or nearly the same hardness at all depths following initial heat treatment. Thus, as a die cavity wears through use and goes oversize, the die sinker will typically shave off the cavity surface to a depth of, say, ½ inch and re-sink a new cavity in alignment with the prior cavity. If the steel has the same hardness, and of course other desirable characteristics, after repeated re-sinkings it has demonstrated excellent hardenability. This is a particularly difficult objective to achieve in large die blocks, say of 12 inches or greater thickness, in the as forged condition prior to sawing in half and sinking.

With the above in mind, the invention is directed specifically to a hot work die block in which excellent hardenability is achieved together with a Di of about 13.5, yet only modest amounts of Ni and Mo are required to attain this objective.

DETAILED DESCRIPTION OF THE INVENTION

As discussed in U.S. Pat. No. 3,970,448 a hot work forging die must have substantial strength since it is subjected to heavy stresses in the forging operation and substantial hardness to insure against premature wear. It must also have good toughness to withstand the heavy and continuous shock loads to which it is subjected in use. Due to the elevated temperatures to which it is exposed in use the die must be resistant to softening and heat checking. Abrasion resistance is also a critical factor, since in use the sliding forces exerted on the surface at elevated temperatures are very substantial.

Most, importantly, the hardenability of the die must be as high and as uniform as possible within cost, toughness and heat treatment limits.

In practice, the cavity initially sunk in the die block from which the die is made eventually wears oversize through use. When the maximum tolerance has been reached the die is removed, the face is cut down to sound metal, and the cavity resunk in the remaining material. This may be repeated several times before the useful life of the die is exhausted. The cost of the dies, including initial cost, hammer and press down time for removal, machining and installation requires that maximum production be obtained after each re-sinking.

Now, if the die has sufficient strength and toughness to remain in service without fracture, the most important use requirement is that the die be of substantially uniform hardness throughout so the production that can be expected from the last sinking is as great as can be expected from the initial sinking.

Accordingly, in this application hardenability is the most important characteristic.

In the practice of this invention, the C content of the steel is preferably significantly lower than the industry norm of 0.55. Specifically, in this invention the C should be in the range of 0.42–0.52 and preferably about 0.47. Carbon is essential for strength and hardness and it is believed that these essential characteristics cannot be achieved if the C content is significantly less than about 0.42. At the same time, it is believed that the former upper conventional limit of 0.60 is unnecessarily high and that, by observing the other conditions hereinafter described, the desired end results can be achieved if the upper limit of C is not significantly greater than 0.52.

The present invention contemplates a modest variation from conventional Si practices, and hence a range of from about 0.25 to 0.35, with an aim of about 0.30, is acceptable.

At the present time the cost of Ni has dramatically increased and hence, though Ni is an important element, particularly for obtaining the toughness required under rough operating conditions, it is preferred that the Ni range be dropped from the conventional 0.75–1.25 as described in U.S. Pat. No. 3,929,423 to 0.65–0.95. The lower Ni, in the presence of the lower C and, as hereinafter described, a lower Mo content will still achieve the requisite toughness. Preferably Ni is present at or near 0.80.

Cr is very substantially increased and should be present in an amount of from about 1.40 up to 1.60. This content is in marked contrast to the widely used practice of providing Ni in the 0.85–1.05 range. Cr is required for deep hardening, wear resistance, tempering resistance and its ability to increase the lower critical temperature. Preferably Cr is at or near 1.50 but, since Cr is far less expensive than Ni, Cr is an element which can be increased.

Mo, a potent carbide former, contributes to resistance to softening, wear resistance and hardenability. Because of its substantial contribution to hardenability, a range of from about 0.30–0.50 is preferred, with an aim at 0.40.

Mn contributes very substantially to hardenability and hence at least about 0.75 should be present. Because of its tendency to attack refractories in the steel making process it is preferred that the upper quantity used be no greater than about 0.95, and preferably no greater than about 0.90. Under no circumstances should Mn be present in amounts significantly above 0.95, such as about 2 percent which the literature has suggested.

Vanadium contributes to fine grain size which has proven to be an important characteristic in this type of product. In order to achieve the desired grain size effect at least about 0.04 V should be present. If more than about 0.10 of V, which is an expensive element, is present, the effect of V on grain size may be insignificant. Hence about 0.05 V is preferred.

Sulphur is essential for machinability and it is commonly believed the sulphur must be present in amounts up to 0.045 in this type of steel in order to attain acceptable machinability. Sulphur does however have several well known deleterious effects in this type of steel, including an increasing tendency toward hot shortness with an increase in sulphur content. It is desirable therefore to use the least quantity of sulphur which will provide the required level of machinability. In the instant invention, sulphur in an amount substantially greater than 0.025 may tend to produce excess sulfides which will deleteriously effect transverse properties. If significantly less than about 0.010 sulphur is present, even under the conditions described herein, the required machinability may not be attained. A more preferred range is up to 0.022 max and excellent results will be attained at an aim of about 0.015.

Since these relatively low sulphur values are related to the presence and quantities of aluminum and calcium, the quantity and treatment of aluminum and calcium are next described.

Aluminum is desirable for grain refinement and, in low quantities, for fluidization of the molten steel. Al has the desirable feature of promoting fine grain and hence should be present in an amount of from about 0.015–0.035. If much less than 0.015 is present the desired grain effect and deoxidation effect during steel making may not be achieved. If significantly greater than 0.035 is present the effect on grain control disappears and other problems rise, such as refractory attack during the steel making process. About 0.025 Al is preferred. Since the amount of aluminum present has been considered to have a significant effect on the quality of aluminates, and aluminates have universally been considered a contaminant, it is conventional wisdom to minimize the amount of aluminum present. (As those skilled in the art appreciate, there are essentially four types of non-metallic inclusions which, in this type of steel, are considered impurities, namely silicates, aluminates, complex oxides, and sulfides.)

The quantity of silicates and aluminates formed are somewhat proportional to the amount of available oxygen in the steel. The complex oxides are thought to be formed largely during tapping and teeming. The amount of sulfides formed will, of course, be proportional to the sulphur or sulphur containing materials in the steel, including sulphur from such sources as scrap and oil in turnings and other scrap materials in the shop, the degree to which furnace or vacuum ladle refining is carried out, and intentional additions such as ladle additions of pyrites to meet the desired sulphur specification. Teeming techniques to reduce oxygen pick up may be employed such as the use of a vacuum or inert atmosphere during teeming and/or elimination of splash through the use of splash pads, no dribble teeming techniques or bottom pouring.

The silicates and aluminates are formed as the oxygen comes out of solution due to temperature drop. It is believed that if, at the time the silicates and aluminates are formed, a condition of oxygen starvation in the molten steel exists the oxide and sulfide formation can be very significantly decreased. Accordingly, it is essential that steps be taken to ensure low oxygen levels in the steel. It has now been confirmed that if a ratio of about 15 percent calcium to aluminum is maintained, the stringer non-metallic inclusions such a $Al_2O_3$ and $SiO_2$ are converted to round globular complex oxides which are finely dispersed throughout the steel. Sulphur is also globularized. As a result the stringer type inclusions which act as stress risers are significantly reduced resulting in better JK ratings, and cleaner and stronger steel. In absolute terms, a Ca content of from about 15 ppm to about 50 ppm can be useful to the steel maker.

The contribution of titanium can best be appreciated by a further reference to the role of inclusions in steel.

The so-called Type II inclusions, category A, are basically sulfides. These compositions when examined under a microscope show up as long string like objects. As mentioned, the sulfur is essential in order to provide machinability, but the "stringers" which are present as a result of the presence of sulfur have a very deleterious effect on reduction of area transverse.

It is known that titanium will have a beneficial effect on the sulfide stringers, but it has been thought that quantities in excess of a very low amount, say about 0.005 to about 0.007, would immediately result in the formation of titanium sulfide and/or titanium oxide, which compounds are as deleterious, if not more so, to the desired properties as are the sulfides.

Note should also be made of the class B, C, and D categories of inclusions which are, respectively, aluminates, silicates, and complex oxides. These latter three categories of inclusions can be as deleterious as the Type A sulfide category of inclusions.

It has been commented that the undesirable effects of the above inclusions can be controlled, that is, transformed to the globular shape, by careful control of the steelmaking process and the addition of the specified amounts of titanium.

Specifically, it is thought that by adding titanium to the steel making process at a point in the processing cycle in which oxygen is at a low level, the tendency to from the deleterious substances TiO and TiS is eliminated, and titanium carbo nitride is formed in preference to aluminum nitrides.

Further, although solid scientific substantiation has not been established, it is believed that aluminum nitrides are held in the grain boundaries thereby causing a weakness of the steel, whereas titanium carbo nitride formations are held within the grains, and enhance the strength of the steel. The aluminum nitrides in the grain boundaries weaken the surface of the ingot and result in panel cracking during forging. The titanium combines actively with the nitrogen to form titanium nitrides which penetrate the grains, thereby eliminating a potential point of cleavage, that is, to say, stress risers, in the grain boundaries. For all the foregoing reasons, Ti should be present in an amount in the range of from about 0.003–0.075, and preferably from about 0.005–0.020.

The concept which has been described above in quantitative terms is, in effect, an application of the concept of ideal critical diameter to achieve a desired product performance.

As is well known, hardenability can be measured and expressed mathematically, (i.e., by the formula $\log D_1 = \log F_c + \log F_{si} + \log F_{ni} + \log F_{cr} + \log F_{mo} + \log F_x$, wherein the expression $D_i$, represents the ideal critical diameter, and the expression $F_c$, $F_{si}$, $F_{ni}$, $F_{cr}$, $F_{mo}$, and $F_x$ are factors which represent the hardenability contribution of each of the elements identified by the chemical symbol in the subscript and, with respect to $F_x$, all other elements which may be present and which contribute to hardenability, all as exemplified by the example on page 78 of Republic Alloy Steels, 1961, Republic Steel Corporation, Cleveland, Ohio,) and related to the ability of a die steel to give satisfactory performance. For example, the ideal critical diameter, hereafter referred to by its conventional abbreviation Dj, is often used as a measure of hardenability. For a more detailed discussion of hardenability and $D_i$, see Republic Alloy Steels, 1961, Republic Steel Corporation, Cleveland, Ohio, pages 75–102, wherein it will be noted that the Ideal Critical Diameter, $D_i$, can be defined as the diameter of a round which, if quenched in a perfect quench, will harden to 50% martinsite at the center. For purposes of this invention, however, the mathematical determination of the $D_i$ as derived from calculations based on chemical composition is of basic importance, rather than any specific measurement of diameter.

It has been discovered that a $D_i$ of at least 10 is most ideal for the rugged operating conditions of a hot work forging steel product to which this invention is directed, and that a steel product which has the above described chemical constituents has a $D_i$ of about 13.5; in fact, the permissible variations in content permit the design and successful use of such products with a range of contents significantly wide to provide the steel maker with very adequate flexibility in the manufacture of the product. Hence the invention provides not only a highly useful end product at lowest cost, but a practical way of forming such a product using conventional and practical steel making techniques.

In this connection it should be noted that it is preferable that the final product contain no more than about 2.2 ppm H to avoid flaking and no more than about 30 ppm 0 to minimize the presence of undesirable inclusions such as silicates and aluminates which can adversely affect wear resistance. It should also be noted that the product is particularly well suited to nitriding and N contents of up to 90 ppm are quite acceptable.

Although several embodiments of the invention have been illustrated and described, it will at once be apparent to those skilled in the art that the invention is not limited to the precise compositions and procedures hereinabove set forth. Accordingly, the scope of the invention should not be limited to the specific examples above set forth, but, rather, should be limited solely by the scope of the hereinafter appended claims when interpreted in light of the relevant prior art.

We claim:

1. A low alloy steel product having high hardenability and good machinability in the presence of a relatively low S content, said steel consisting essentially of the following composition in weight percent:

| | | | | |
|---|---|---|---|---|
| C | from about | .42 | to about | .52 |
| Si | from about | .15 | to about | .35 |
| Ni | from about | .65 | to about | .95 |
| Cr | from about | 1.40 | to about | 1.60 |
| Mo | from about | .30 | to about | .50 |
| Mn | from about | .75 | to about | .95 |
| V | from about | .04 | to about | .10 |
| S | from about | .010 | to about | .025 |
| Ti | from about | .003 | to about | .075 |
| Al | from about | .015 | to about | .030 |
| Ca | about 15% of Al | | | |
| H | 2.2 ppm max | | | |
| O | 30 ppm max | | | |
| Fe | balance and non-deleterious impurities | | | |

2. The low alloy steel product of claim 1 further characterized in that said steel product consists essentially of the following composition in weight percent:

| |
|---|
| C about .47 |
| Si about .30 |
| Ni about .80 |
| Cr about 1.50 |
| Mo about .40 |
| Mn about .90 |
| V about .05 |
| S about .022 max |
| Ti about .005–.020 |
| Al about .015–.020 |
| Ca about 15% of Al |
| H 2.2 ppm max |
| O 30 ppm max |
| Fe balance and non-deleterious impurities |

3. The low alloy steel product of claim 2 further characterized in that S is present in an amount of about 0.015.

4. The low alloy steel product of claim 1 further characterized in that S is present in an amount of about 0.015.

* * * * *